US005316881A

United States Patent [19]

Nakamura et al.

[11] Patent Number: 5,316,881

[45] Date of Patent: May 31, 1994

[54] PHOTOCONDUCTOR FOR ELECTROPHTOGRAPHY CONTAINING BENZIDINE DERIVATIVE

[75] Inventors: Yoichi Nakamura; Nobuyoshi Mori; Sumitaka Nogami, all of Kawasaki, Japan

[73] Assignee: Fuji Electric Co., Ltd., Kanagawa, Japan

[21] Appl. No.: 993,029

[22] Filed: Dec. 18, 1992

[30] Foreign Application Priority Data

Dec. 27, 1991 [JP] Japan ..... 3-345750
Jun. 5, 1992 [JP] Japan ..... 4-144658

[51] Int. Cl.[5] ..... G03G 5/047; G03G 5/09

[52] U.S. Cl. ..... 430/59; 430/76; 430/77; 430/78; 430/79; 430/83

[58] Field of Search ..... 430/59, 76, 77, 78, 430/79, 83

[56] References Cited

U.S. PATENT DOCUMENTS

| | | | |
|---|---|---|---|
| 3,189,447 | 6/1965 | Neugebauer et al. . | |
| 3,484,237 | 12/1969 | Shattuck et al. . | |
| 3,816,118 | 6/1974 | Byrne . | |
| 4,150,987 | 4/1979 | Anderson et al. . | |
| 4,265,990 | 5/1981 | Stolka et al. | 430/59 |
| 4,278,747 | 7/1981 | Murayama et al. | 430/82 |
| 4,346,158 | 8/1982 | Pai et al. | 430/59 |
| 4,353,971 | 10/1982 | Chang et al. | 430/58 |
| 4,367,273 | 1/1983 | Murayama et al. | 430/56 |
| 4,385,106 | 5/1983 | Sakai | 430/59 |
| 4,415,640 | 11/1983 | Goto et al. | 430/59 |
| 4,448,868 | 5/1984 | Suzuki et al. | 430/58 |
| 4,565,761 | 1/1986 | Katagiri et al. | 430/83 |
| 4,568,623 | 2/1986 | Makino et al. | 430/58 |
| 4,606,986 | 8/1986 | Yanus et al. | 430/59 |
| 4,624,904 | 11/1986 | Kazmaier et al. | 430/59 |
| 4,629,670 | 12/1986 | Katagiri et al. | 430/58 |
| 4,629,672 | 12/1986 | Makino et al. | 430/76 |
| 4,666,809 | 5/1987 | Matsumoto et al. | 430/76 |
| 4,673,630 | 6/1987 | Katagiri et al. | 430/72 |
| 4,677,045 | 6/1987 | Champ et al. | 430/76 |

(List continued on next page.)

FOREIGN PATENT DOCUMENTS 0034942 9/1981 European Pat. Off. .

(List continued on next page.)

OTHER PUBLICATIONS

Johnson, R. N., et al., "Poly(aryl Ethers) by Nucleophilic Aromatic Substitution. I. Synthesis and Properties", *Journal of Polymer Science*, Part A-1, vol. 5, pp. 2375-2398 (1967).

*Primary Examiner*—Roland Martin
*Attorney, Agent, or Firm*—Spencer, Frank & Schneider

[57] ABSTRACT

The photoconductor for electrophotography comprises an electroconductive substrate and a photosensitive layer formed on the substrate. The photosensitive layer may be a monolayer or function-separated laminate type one which comprise a charge generating layer and a charge transporting layer laminated one on another. The charge generating layer contains a specified benzidine compound represented by general formula (I) below as the charge transporting substance.

(I)

wherein $R_1$, $R_2$, $R_3$ and $R_4$, which are the same or different, each represent independently an aryl group, an alkylaryl group, an alkoxyaryl group or a halogenated aryl group provided that $R_1$ and $R_2$, or $R_3$ and $R_4$, or both combine and form a condensed aromatic group with the nitrogen atom to which they are bonded, respectively; $R_5$ and $R_6$ each represent independently a hydrogen atom, an alkyl group, an alkoxy group, or a halogen atom.

18 Claims, 2 Drawing Sheets

U.S. PATENT DOCUMENTS

| | | | |
|---|---|---|---|
| 4,702,983 | 10/1987 | Kazuhiro et al. | 430/75 |
| 4,731,315 | 3/1988 | Horie et al. | 430/77 |
| 4,783,387 | 11/1988 | Ueda | 430/76 |
| 4,808,503 | 2/1989 | Yamada et al. | 430/75 |
| 4,833,054 | 5/1989 | Akasaki et al. | 430/59 |
| 4,839,252 | 6/1989 | Murata et al. | 430/59 |
| 4,861,691 | 8/1989 | Kuroda et al. | 430/59 |
| 4,861,692 | 8/1989 | Kuroda et al. | 430/59 |
| 4,865,934 | 9/1989 | Ueda et al. | 430/59 |
| 4,871,636 | 10/1989 | Hattori et al. | 430/77 |
| 4,877,703 | 10/1989 | Kuroda et al. | 430/76 |
| 4,882,255 | 11/1989 | Hattori et al. | 430/73 |
| 4,910,110 | 3/1990 | Kuroda et al. | 430/59 |
| 4,917,981 | 4/1990 | Nakamura et al. | 430/75 |
| 4,920,022 | 4/1990 | Sakakibara et al. | 430/59 |
| 4,929,525 | 5/1990 | Kuroda et al. | 430/75 |
| 4,931,371 | 6/1990 | Matsumoto et al. | 430/59 |
| 4,935,323 | 6/1990 | Hattori et al. | 430/58 |
| 4,945,021 | 7/1990 | Takata et al. | 430/76 |
| 4,948,689 | 8/1990 | Kuroda et al. | 430/59 |
| 4,950,572 | 8/1990 | Kuroda et al. | 430/59 |
| 4,954,405 | 9/1990 | Sugata et al. | 430/58 |
| 4,956,250 | 9/1990 | Kuroda et al. | 430/58 |
| 4,956,255 | 9/1990 | Ueda | 430/59 |
| 4,956,277 | 9/1990 | Kuroda et al. | 430/58 |
| 4,957,837 | 9/1990 | Kuroda et al. | 430/59 |
| 4,971,876 | 11/1990 | Kuroda | 430/75 |
| 4,985,325 | 1/1991 | Kuroda et al. | 430/59 |
| 4,988,594 | 1/1991 | Hattori et al. | 430/59 |
| 5,080,991 | 1/1992 | Ono et al. | 430/73 |
| 5,087,541 | 2/1992 | Kuroda et al. | 430/58 |
| 5,089,365 | 2/1992 | Kuroda et al. | 430/59 |
| 5,096,794 | 3/1992 | Kuroda et al. | 430/58 |
| 5,100,750 | 3/1992 | Kuroda et al. | 430/72 |
| 5,132,189 | 7/1992 | Kuroda et al. | 430/58 |
| 5,134,049 | 7/1992 | Kuroda et al. | 430/58 |
| 5,158,848 | 10/1992 | Kuroda et al. | 430/59 |
| 5,178,981 | 1/1993 | Hattori et al. | 430/58 |
| 2944949 | 6/1980 | Fed. Rep. of Germany . | |
| 3019909 | 11/1980 | Fed. Rep. of Germany . | |
| 3022545 | 1/1981 | Fed. Rep. of Germany . | |
| 3138292 | 5/1982 | Fed. Rep. of Germany . | |
| 3141306 | 6/1982 | Fed. Rep. of Germany . | |
| 3139524 | 8/1982 | Fed. Rep. of Germany . | |
| 3203621 | 9/1982 | Fed. Rep. of Germany . | |
| 3208337 | 9/1982 | Fed. Rep. of Germany . | |
| 3303830 | 8/1983 | Fed. Rep. of Germany . | |
| 3320674 | 12/1983 | Fed. Rep. of Germany . | |
| 3602987 | 10/1986 | Fed. Rep. of Germany . | |
| 3643341 | 6/1987 | Fed. Rep. of Germany . | |
| 3841207 | 6/1989 | Fed. Rep. of Germany . | |
| 3842253 | 6/1989 | Fed. Rep. of Germany . | |
| 2623638 | 11/1988 | France . | |
| 10785 | 5/1972 | Japan . | |
| 37543 | 12/1972 | Japan . | |
| 25658 | 7/1973 | Japan . | |
| 47344 | 7/1973 | Japan . | |
| 66444 | 12/1973 | Japan . | |
| 69332 | 7/1974 | Japan . | |
| 10496 | 4/1975 | Japan . | |
| 39952 | 4/1975 | Japan . | |
| 10138 | 1/1977 | Japan . | |
| 25638 | 2/1977 | Japan . | |
| 53-27003 | 3/1978 | Japan . | |
| 150128 | 11/1979 | Japan . | |
| 138263 | 4/1980 | Japan . | |
| 138264 | 4/1980 | Japan . | |
| 138265 | 4/1980 | Japan . | |
| 138266 | 4/1980 | Japan . | |
| 153814 | 4/1980 | Japan . | |
| 132965 | 9/1980 | Japan . | |
| 42380 | 10/1980 | Japan . | |
| 166557 | 11/1980 | Japan . | |
| 12646 | 2/1981 | Japan . | |
| 60433 | 5/1981 | Japan . | |

FOREIGN PATENT DOCUMENTS

| | | |
|---|---|---|
| 0131140 | 1/1985 | European Pat. Off. . |
| 0270685 | 6/1988 | European Pat. Off. . |
| 0347967 | 12/1989 | European Pat. Off. . |
| 1058836 | 6/1959 | Fed. Rep. of Germany . |
| 1105714 | 4/1961 | Fed. Rep. of Germany . |
| 1908343 | 8/1969 | Fed. Rep. of Germany . |
| 1921273 | 11/1969 | Fed. Rep. of Germany . |
| 2041490 | 3/1971 | Fed. Rep. of Germany . |
| 2046914 | 8/1971 | Fed. Rep. of Germany . |
| 2110971 | 12/1971 | Fed. Rep. of Germany . |
| 2357851 | 6/1974 | Fed. Rep. of Germany . |

PHOTOCONDUCTOR FOR ELECTROPHTOGRAPHY CONTAINING BENZIDINE DERIVATIVE

BACKGROUND OF THE INVENTION

1. Field of the Invention

The present invention relates to a photoconductor for electrophotography, and more particularly to a photoconductor for electrophotography which includes an electroconductive substrate having thereon a photosensitive layer containing a benzidine compound.

2. Description of the Prior Art

Photoconductors for electrophotography (hereafter, sometimes referred to simply as "photoconductors") each include an electroconductive substrate having thereon a photosensitive layer containing a photoconductive material. In the electrophotographic image formation system according to Carlson, a photoconductor is subjected in the dark to corona discharge to charge the photoconductor, the surface of the charged photoconductor is imagewise exposed to light using a manuscript or copy bearing, e.g., letters and/or pictures to form a latent electrostatic image, the thus formed latent electrostatic image is developed with a toner to form a visible image, the developed toner image is transferred to a support such as a paper sheet to fix the toner image on the support. After the toner image transfer, the photoconductor is subjected to the steps of removal of the electric charge and removal of the remaining toner (cleaning), and the like to be ready for reuse for a prolonged period of time.

Therefore, photoconductors are required to have not only sufficient electrophotographic characteristics such as charge generating properties, surface charge maintaining properties in the dark, and fly-off of charges upon exposure to light (light sensitivity) but also sufficient durability upon repeated use for a long time. In addition, they are required to have sufficient resistances to changes in the environmental conditions upon their use.

Heretofore, use has been widely made of photoconductors having photosensitive layers in which inorganic photoconductive materials containing selenium, zinc oxide, cadmium sulfide or the like as a major component. However, these inorganic photoconductors have not always been satisfactory in light sensitivity, resistances to environmental conditions, non-toxicity, etc.

Besides the photoconductors for electrophotography utilizing inorganic materials, those containing organic materials, have recently been studied and developed.

Organic photoconductors are generally less toxic than inorganic photoconductors. The organic photoconductors have attracted much attention by virtue of the advantageous features of the organic materials such as transparency, flexibility, lightweight, productivity, etc., as compared with the inorganic materials. For example, Japanese Patent Publication No. 10496/1975 discloses a photoconductor composed of poly-N-vinylcarbazole and 2,4,4-trinitro-o-fluorenone while Japanese Patent Publication No. 25658/1973 described a photoconductor composed of poly-N-vinylcarbazole sensitized with a pyrylium dye. However, such conventional photoconductors are not totally sufficient for their light sensitivity and durability.

In later days, so-called function-separated type laminate photoconductors in which a charge generating layer and a charge transporting layer are provided separately have been developed. For example, Japanese Patent Publication No. 42380/1980 discloses a function-separated type photoconductor which uses chlorocyan blue and a hydrazone compound. As described above, division of the photosensitive layer into a charge generating layer and a charge transporting layer, or sharing of functions by different layers, facilitated the fabrication of photoconductors with various characteristics, further development has been made with expectation to obtaining photoconductors with high light sensitivities and high durabilities.

Generally, the following properties are important for the performance of the function-separated type laminate photoconductors.

1) The charge generating layer must have a high optical absorption coefficient, a high quantum efficiency, and the charge generated must flow to the substrate efficiently and injected into the charge transporting layer efficiently.

2) The charge transporting layer must allow the charge generated in the charge generating layer to be injected therein efficiently and to transport quickly therethrough without being trapped to off-set the surface charge.

In order to meet the above requirements intensive research has been made to develop charge generating substances and charge transporting substances having improved performances as well as combinations of a charge generating layer with a charge transporting layer which can give high injection efficiencies. Various interpretations have been made on what contributes to improved injection efficiency of the combination, but no method has been established yet that can be applied generally; actually, various attempts have been made to experimentally find optimal combinations on try-and-error basis with selecting particular combinations from various charge generating substances, charge transporting substances, binders, solvents, additives and the like.

Photoconductor for electrophotography have already been known which contain N,N,N',N'-substituted benzidines as the charge transporting substance. For example, Japanese Patent Application Laid-Open No. 27033/1978 disclosed photoconductors containing benzidine compounds such as N,N'-diphenyl-N,N'-bis(2-methylphenyl)-1,1'-biphenyl-4,4'-diamine, N,N'-diphenyl-N,N'-bis(3-methylphenyl)-1,1'-biphenyl-4,4'-diamine, etc. With view to improving the compatibility of the aforementioned benzidine compounds with binders, Japanese Patent Application Laid-Open No. 132955/1986 proposed the use of benzidine compounds having substituents at the 3,3'-positions of the biphenyl skeleton, such as 3,3'-dimethyl-N,N,N',N'-tetraphenyl-1,1'-biphenyl-4,4'-diamine, as a charge transporting substance.

Furthermore, Japanese Patent Application Laid-Open No. 201447/1987 and Japanese Patent Application Laid-Open No. 315751/1989 proposed the use of asymmetric benzidine compounds whose substituents at the 4,4'-positions of the 1,1'-biphenyl-4,4'-diamines are different as a charge transporting substance. These asymmetric benzidine compounds were said to have superior sensitivities, less changes in the characteristics after repeated use and less occurrence of memorization phenomenon while the machine is in a stop mode over the symmetric benzidine compounds.

The aforementioned conventional proposals relate to the use of diamines of which one or both of the amino groups are diaryl-substituted. Investigation by the present inventors on photoconductors which used such diaryl-substituted diamines as a charge transporting substance revealed that although the initial characteristics of the photoconductor containing the diamines were relatively good the characteristics became gradually deteriorated while use was repeated for a long time. The deterioration was severer when the photoconductors were used at higher temperatures for a longer time.

The deterioration of the photoconductor causes failure of reproducing sufficient image density and other defects in the case of a high speed electrophotographic machine which is operated at high internal temperatures with the photoconductor being inevitably exposed to high temperature.

SUMMARY OF THE INVENTION

Under the circumstances, the present invention has been made, and it is an object of the present invention to provide a photoconductor which uses a novel charge transporting substance and has a high sensitivity that will not be deteriorated after repeated use for a long time and is resistant to changes in the environment.

As a result of extensive investigation, it has now been found that the above object can be achieved by the use of specified benzidine compounds as a charge generating substance. The present invention has been completed based on this discovery.

According to the present invention, there is provided a photoconductor for electrophotography which comprises:

a substrate; and a photosensitive layer formed on the substrate, wherein the photosensitive layer contains a benzidine compound represented by general formula (I):

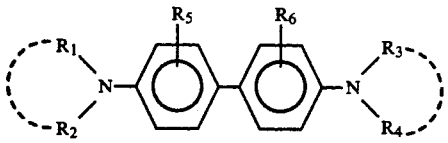

(I)

wherein $R_1$, $R_2$, $R_3$ and $R_4$, which are the same or different, each represent independently an aryl group, an alkylaryl group, an alkoxyaryl group or a halogenated aryl group provided that $R_1$ and $R_2$, or $R_3$ and $R_4$, or both combine and form a condensed aromatic ring with the nitrogen atom to which they are bonded, respectively; and $R_5$ and $R_6$ each represent independently a hydrogen atom, an alkyl group, an alkoxy group, or a halogen atom.

Here, the benzidine compound may be a compound represented by general formula (II)

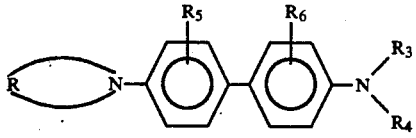

(II)

wherein R represents a group of elements which form a condensed aromatic ring with the nitrogen atom to which they are bonded; $R_3$ and $R_4$, which are the same or different, each represent independently an aryl group, an alkylaryl group, an alkoxyaryl group or a halogenated aryl group; and $R_5$ and $R_6$ each represent independently a hydrogen atom, an alkyl group, an alkoxy group, or a halogen atom.

The benzidine compound may be a compound represented by general formula (III)

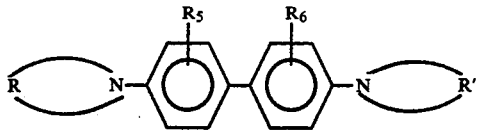

(III)

wherein R and R' each represent a group of elements which form a condensed aromatic ring together with the nitrogen atom to which they are bonded; and $R_5$ and $R_6$ each represent independently a hydrogen atom, an alkyl group, an alkoxy group, or a halogen atom.

The photoconductor may be of a laminate, function-separated photosensitive layer having a charge generating layer and a charge transporting layer.

The photosensitive layer may be of a monolayer.

The charge transporting substance used in the the present invention has satisfactory compatibility with various binder resins and therefore a photoconductor can be obtained with the transporting substance which has sufficient charge maintaining property and light sensitivity, and low residual potential, and its characteristics are not susceptible to changes in the environment and thus it is highly stable and durable.

The above and other objects, effects, features and advantages of the present invention will become more apparent from the following description of embodiments thereof taken in conjunction with the accompanying drawings.

DETAILED DESCRIPTION OF THE INVENTION

The photoconductor of the present invention, which contains the specified benzidine compound as a charge generating substance in the photosensitive layer thereof, may have any one of various known structures for photoconductors for electrophotography. The specified benzidine compound will be explained in detail later on.

Usually, the photoconductor of the present invention may have any one of the structures shown in FIGS. 1 to 6.

FIGS. 1 to 6 are schematic cross sectional views showing photoconductors according to various embodiments of the present invention.

Figure 1:
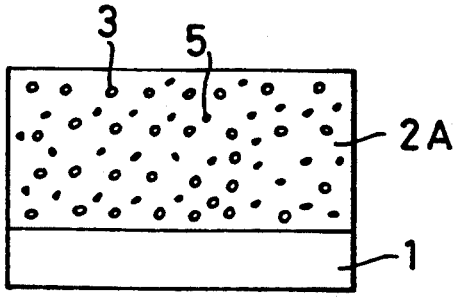
FIGS. 1 and 2 are schematic cross-sectional views showing monolayer photoconductors according to the present invention.

FIG. 1 is a cross sectional view showing a monolayer type photoconductor. A photosensitive layer 2A is provided on an electroconductive substrate 1. The photosensitive layer 2A comprises the above-mentioned benzidine compound as a charge generating substance 3, and a charge transporting substance 5 both of which substances are dispersed in a resin binder matrix so that the photosensitive layer 2A functions as a photoconductor.

Figure 2:
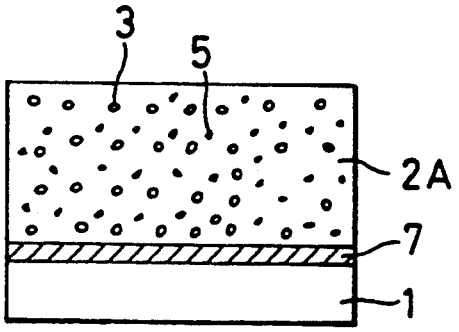

FIG. 2 is a cross sectional view showing another monolayer type photoconductor. The photoconductor shown in FIG. 2 differs from that shown in FIG. 1 in that the photosensitive layer 2A is provided on the substrate 1 via one or more intermediate layers 7 such as a subbing layer, a barrier layer, etc.

Figure 3:
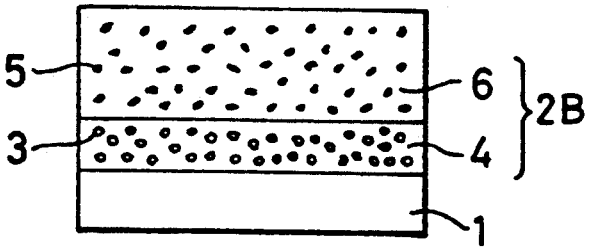
FIGS. 3 to 6 are schematic cross-sectional views showing function-separated laminate photoconductors according to the present invention.

FIG. 3 is a cross sectional view showing a laminate type photoconductor. A laminated photosensitive layer 2B is provided on an electroconductive substrate 1, in which a lower layer of the laminate is a charge generating layer 4 including the above-mentioned benzidine compound as a charge generating substance 3, and an upper one is a charge transporting layer 6 containing a charge transporting substance 5 as a main component, so that the photosensitive layer 2B functions as a photoconductor. This photoconductor is usually used according to the negative charge mode.

Figure 4:
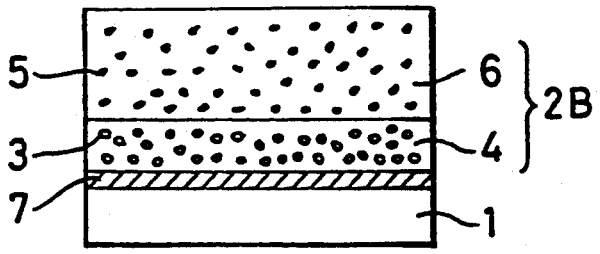

FIG. 4 is a cross sectional view showing another laminate type photoconductor shown in FIG. 3. The photoconductor shown in FIG. 4 differs from that shown in FIG. 1 in that the photosensitive layer 2B is provided on the substrate 1 via one or more intermediate layers 7 such as a subbing layer, a barrier layer, etc.

Figure 5:
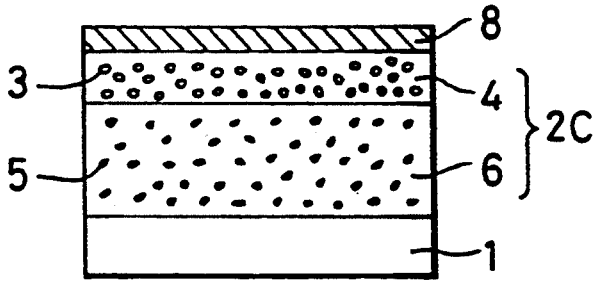

FIG. 5 is another laminate type photoconductor having a layer structure in reverse to that shown in FIG. 3. A laminated photosensitive layer 2C is provided on an electroconductive substrate 1, in which a lower layer of the laminate is a charge transporting layer 6 including the above-mentioned benzidine compound as a charge transporting substance 5 as a main component, and an upper one is a charge generating layer 4 containing a charge generating substance 3, so that the photosensitive layer 2C functions as a photoconductor. This photoconductor is usually used according to the positive charge mode. In this case, a cover layer 8 may generally be further provided as shown in FIG. 5 to protect the charge generating layer 4.

Figure 6:
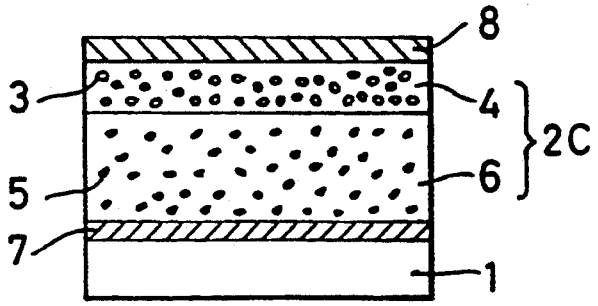

FIG. 6 is a cross sectional view showing another laminate type photoconductor shown in FIG. 5. The photoconductor shown in FIG. 6 differs from that shown in FIG. 1 in that the photosensitive layer 2C is provided on the substrate 1 via one or more intermediate layers 7 such as a subbing layer, a barrier layer, etc.

The photoconductors as shown in FIGS. 1 and 2 can be produced by dispersing a charge generating substance in a solution of a charge transporting substance and a resin binder and applying the resulting dispersion on an electroconductive substrate after optionally applying thereon one or more intermediate layers, and then drying the resulting coating film.

The photoconductors as shown in FIGS. 3 and 4 can be produced by applying on an electroconductive substrate a dispersion of a particulate charge generating substance in a solvent and/or a resin binder after optionally applying thereon one or more intermediate layers, applying the resulting dispersion on an electroconductive substrate, followed by applying a solution of a charge transporting substance and a binder resin, and then drying the resulting coating film.

The photoconductors as shown in FIGS. 5 and 6 can be produced by applying a solution of a charge transporting substance and a binder resin on an electroconductive substrate after optionally coating one or more intermediate layers, drying the resulting coating film, applying a dispersion of a particulate charge generating substance in a solvent and/or a resin binder, followed by drying the coating film.

The photosensitive layer in the photoconductor of the present invention contains a benzidine compound represented by general formula (I):

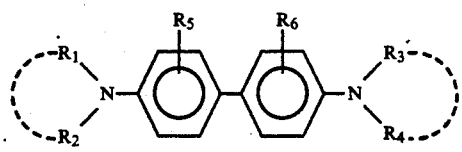

(I)

wherein $R_1$, $R_2$, $R_3$ and $R_4$, which are the same or different, each represent independently an aryl group, an alkylaryl group, an alkoxyaryl group or a halogenated aryl group provided that $R_1$ and $R_2$, or $R_3$ and $R_4$ or both combine and form a condensed aromatic ring with the nitrogen atom to which they are bonded; and $R_5$ and $R_6$ each represent independently a hydrogen atom, an alkyl group, an alkoxy group, or a halogen atom.

The benzidine compound represented by general formula (I) may include those represented by general formulae (II) and (III), respectively, below.

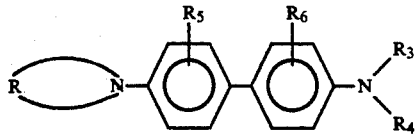

(II)

wherein R represents a group of elements which form a condensed aromatic ring with the nitrogen atom to which they are bonded; $R_3$ and $R_4$, which are the same or different, each represent independently an aryl group, an alkylaryl group, an alkoxyaryl group or a halogenated aryl group; and $R_5$ and $R_6$ each represent independently a hydrogen atom, an alkyl group, an alkoxy group, or a halogen atom.

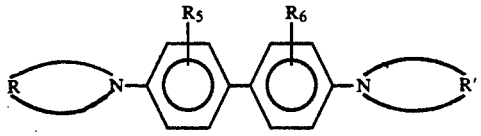

(III)

wherein R and R' each represent a group of elements which form a condensed aromatic ring with the nitrogen atom to which they are bonded; and $R_5$ and $R_6$ each represent independently a hydrogen atom, an alkyl group, an alkoxy group, or a halogen atom.

In general formulae (I), (II) and (III), the aryl group, which is monocyclic or polycyclic, may have 4 to 22, preferably 6 to 13, carbon atoms, and include, for example, a phenyl group naphthyl group, an indolyl group, a carbazolyl group, a tetrahydroquinolyl group, etc.

The alkylaryl group may be those containing a straight chain or branched alkyl moiety having 1 to 10, preferably 1 to 4, carbon atoms (such as a methyl, ethyl, isopropyl, or t-butyl moiety), and the aryl moiety same as the aryl group described above (such as phenyl, naphthyl or the like moiety), for example, a 4-methylphenyl group.

The alkoxyaryl group may be those containing a straight chain or branched alkoxy moiety having 1 to 10, preferably 1 to 4, carbon atoms (such as a methoxy, ethoxy, isopropoxy, or butoxy moiety), and the aryl moiety same as the aryl group described above (such as phenyl, naphthyl or the like moiety), for example, a 4-methoxyphenyl group.

The halogenated aryl group may be the aryl group described above substituted with one or more halogen atoms (such as fluorine, chlorine, bromine, or iodine).

The condensed heterocyclic ring formed by $R_1$ and $R_2$ together with the N atom to which they are bonded, or by $R_3$ and $R_4$ together with the N atom to which they are bonded may include the following rings.

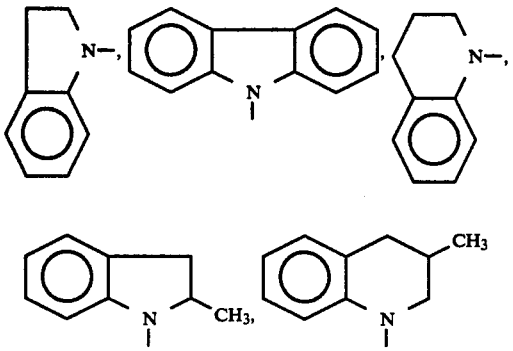

Specific examples of the benzidine compound used in the present invention include the following compounds.

(1)

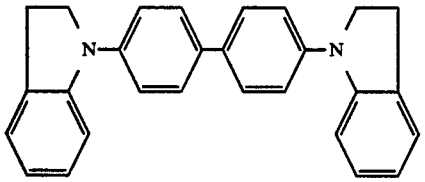

(2)

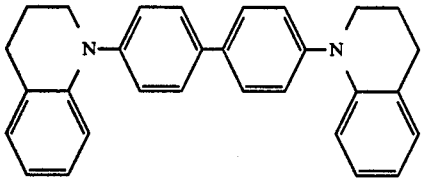

(3)

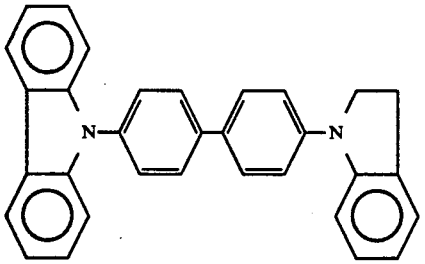

(4)

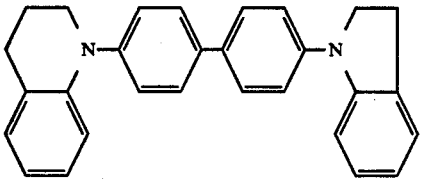

-continued (5)

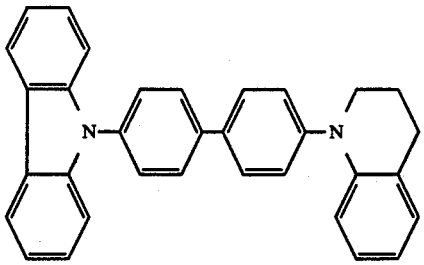

(6)

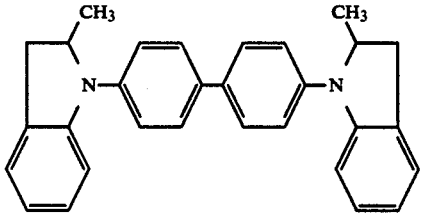

(7)

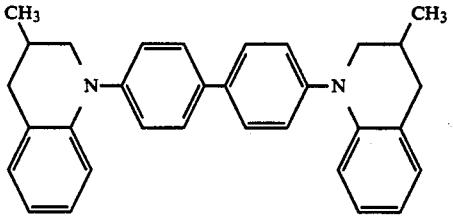

(8)

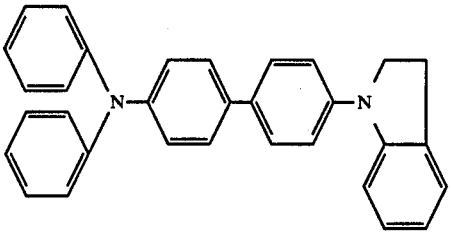

(9)

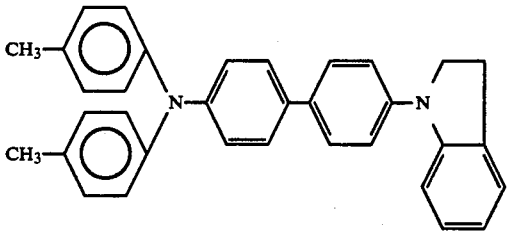

(10)

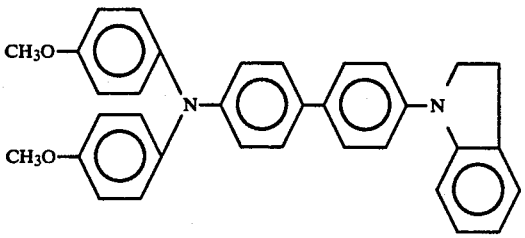

-continued (11)

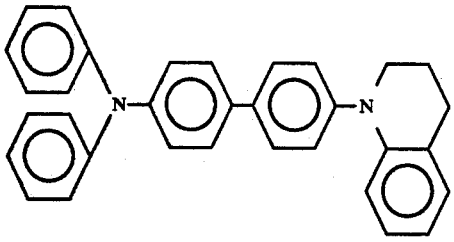

(12)

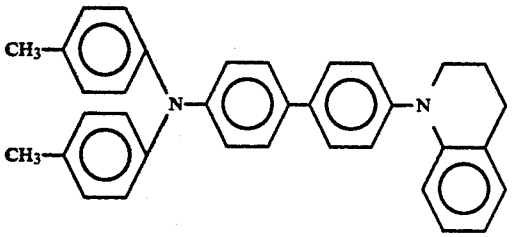

(13)

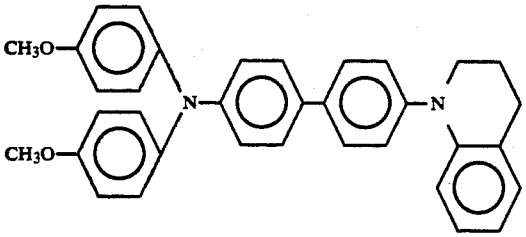

(14)

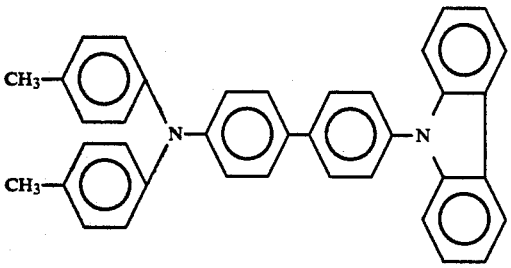

(15)

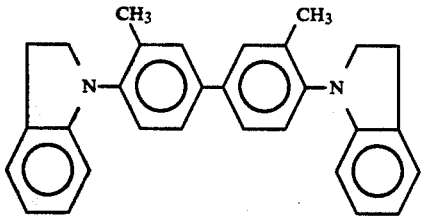

(16)

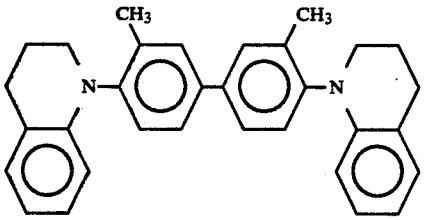

-continued (17)

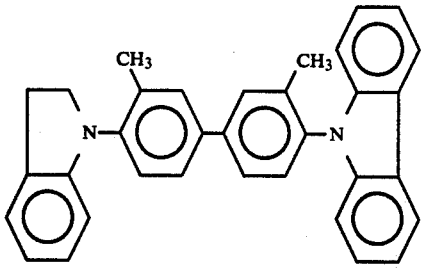

(18)

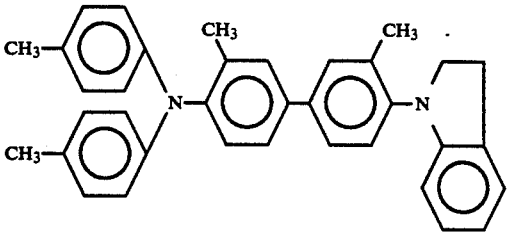

Of the above-described compounds, compounds (8), (9), (10), (11), (12), (13), (14) and (18) are embraced by general formula (II), and compounds (1), (2), (3), (4), (5), (6), (7) and (15) are embraced by general formula (III).

As described above, the photoconductor for electrophotography according to the present invention has a photosensitive layer on an electroconductive substrate.

Various materials can be used as the electroconductive substrate. For example, there can be used metals such as iron, nickel, copper and aluminum, metal-deposited plastic films, electroconductive plastics, and the like. These can be in any form including sheet, belt, cylinder, etc. As necessary, one or more intermediate layers such as an electroconductive subbing layer, a barrier layer or the like may be provided on the electroconductive substrate.

The photosensitive layer, which is provided on the electroconductive substrate directly or via one or more intermediate layers, may be a monolayer photosensitive layer which is provided by dispersing and dissolving a charge generating substance and a charge transporting substance in a binder and applying the resulting dispersion on the substrate. Alternatively, the photosensitive layer may be a function-separated laminate photosensitive layer which is provided by applying a charge generating layer containing a charge generating substance and a charge transporting layer containing a charge transporting substance separately adjacent to each other.

The benzidine compound used as a charge transporting substance in the present invention can be applied in the both types of the photoconductors.

When it is used in a monolayer photosensitive layer, the charge generating substance which can be used include selenium, selenium-tellurium, amorphous silicon, polycrystalline silicon, pyrilium salts, squarylium salts, pyrrolopyrrole compounds, anthanthrone compounds, perylene compounds, disazo compounds, phthalocyanine compounds, etc. These can be used singly or two or more of them can be used in combination. The charge generating substance and the charge transporting substance represented by general formula (I) above are dispersed and dissolved in a suitable binder. The charge transporting substance need not be limited to the benzidine compounds but those charge transporting substances other than benzidine compounds such as hydrazone compounds and fluorenone compounds as disclosed in Japanese Patent Application Laid-Open No. 1151/1991 can be added in addition. The amount of the charge transporting substances other than the benzidine compounds may be added up to 90% by weight based on the total weight of the charge transporting substances. The benzidine compounds represented by general formula (I) above may be used singly or in combination of two or more of them.

The charge generating substance and charge transporting substance can be used together with various binder resins, for example, polystyrenes, acrylic resins, ethylene copolymers, polyvinyl chlorides, polyesters, polyamides, polyurethanes, epoxy resins, polyarylates, polycarbonates, polyethers, silicone resins, etc. Polystyrenes, poly(meth)acrylates, polyesters, and polycarbonates are used practically in most cases.

When the photoconductor is formed as a monolayer photoconductor, there can be used 2 to 20 parts by weight, preferably 3 to 15 parts by weight, of the charge generating substance and 40 to 200 parts by weight, preferably 50 to 100 parts by weight, of the charge transporting substance, per 100 parts by weight of the binder resin. The binder, charge generating substance, charge transporting substance, and optionally an antioxidant, an ultraviolet absorbent, and a levelling agent are dispersed in a solvent such as tetrahydrofuran, methyl ethyl ketone, dioxane, acetone, dichloromethane, dichloroethane using a conventional disperser such as a ball mill, a paint shaker, a sand mill, or attritor. The resulting dispersion can be coated to a thickness of 10 to 50 μm (dry basis) by a conventional coating method such as spraying, dipping, curtain flow coating, or screen coating.

In the case of a function-separated photoconductor having a charge generating layer and a charge transporting layer separately, the photosensitive layer is composed of a charge generating layer and a charge transporting layer.

For the charge generating layer, the charge generating substances explained above relative to the monolayer photoconductor may also be used. As particularly advantageous charge generating substance, there can be selected dibromoanthanthrone, azo pigments, and phthalocyanine pigments. The charge generating layer can be formed by dispersing the above-mentioned charge generating substance in a binder and applying the resulting dispersion on an electroconductive substance. Examples of the resin which can be used advantageously as a binder include polyvinyl formals, polyvinyl acetals, polyvinyl butyrals, phenoxy resins, polyesters, polycarbonates, epoxy resins, melamine resins, vinyl chloride copolymers, etc. The content of the binder in the charge generating layer is suitably 60% by weight or less, preferably 50% by weight or less, and 10% by weight or more, preferably 30% by weight or more. The charge generating substance and the binder resin are dispersed together with a solvent for the binder resin using a conventional disperser such as a sand mill, a paint shaker or an attritor, and the resulting dispersion is coated to a thickness of, for example, 3 μm or less, preferably 0.01 to 1 μm. The charge transporting layer provided adjacent to the charge generating layer is formed by dispersing the compound represented by general formula (I) together with a binder and a suitable solvent, and coating the resulting dispersion is coated and dried.

The binder resin used for the charge transporting layer includes polyesters, polysulfones, polyketones, polycarbonates, poly(meth)acrylates, polystyrenes, etc. In the present invention, the benzidine compound represented by general formula (I) used as a charge transporting substance is blended in a proportion of preferably 10 to 300 parts by weight per 100 parts by weight of the binder. Various solvents may be used depending on the solubility of the binder therein. Specific examples of the solvent which can be used include alcohols such as methanol, ethanol, and butanol; ketones such as acetone, methyl ethyl ketone, methyl isobutyl ketone, and cyclohexanone; ethers such as tetrahydrofuran, dioxane, and ethylene glycol monomethyl ether; esters such as methyl acetate, ethyl acetate; halogenated hydrocarbons such as chloroform, dichloromethane, dichloroethane, dichloroethylene, and trichloroethane; and aromatic hydrocarbons such as toluene, xylene, and dichlorobenzene. The dispersion is used at a solid content of 10 to 60% by weight, preferably 20 to 40% by weight. The coating liquid is coated by a conventional coating method such as spray coating, dip coating, or curtain flow coating, and drying to form a charge generating layer having a thickness of 5 to 50 μm, preferably 10 to 40 μm.

The resin which can be used for forming a subbing layer includes thermoplastic resins such as polyamides polyesters, and vinyl chloride/vinyl acetate copolymers, or thermosetting resin, for example, a thermosetting resin obtained by thermal polymerization of a compound having a plurality of active hydrogen atoms (i.e., hydrogen in —OH group, —$NH_2$ group, —NH group, etc.) together with a compound having a plurality of isocyanate groups and/or a compound having a plurality of epoxy groups, and polyvinyl alcohol. The thickness of the subbing layer is 0.05 to 10 μm, preferably 0.1 to 1.0 μm.

The barrier layer 7 may be composed of casein, polyvinyl alcohol, nitrocellulose, ethylene/acrylic acid copolymer, polyamides (nylon-6, nylon-66, nylon-610, copolymer nylons, alkoxymethylated nylons, etc.), polyurethanes, gelatin, or the like.

The thickness of the barrier may be 0.1 to 5 μm, preferably 0.5 to 3 μm.

The cover layer 8 is made of an organic insulating film forming material such as polyester, polyamide or the like which may contain an inorganic material such as $SiO_2$, an electric resistance-lowering material such as a metal or a metal oxide, or the like. The thickness of the cover layer may be 0.05 to 10 μm, preferably 0.1 to 5 μm.

The charge transporting substance used in the present invention has an excellent compatibility with various binder resins.

General processes for preparing the benzidine compounds used in the present invention will be explained below.

1) A compound represented by general formula (I) in which both $R_1$ and $R_2$, and $R_3$ and $R_4$ combine and form a condensed aromatic ring, respectively, (i.e., a compound represented by general formula (III)), can be prepared by heating a corresponding 4,4'-diiodobiphenyl compound (IV) and a condensed aromatic secondary amines (Va) and (Vb), such as indoline or 1,2,3,4-tetrahydroquinoline, in a solvent such as sulfolane together with anhydrous potassium carbonate, and copper powder for condensation.

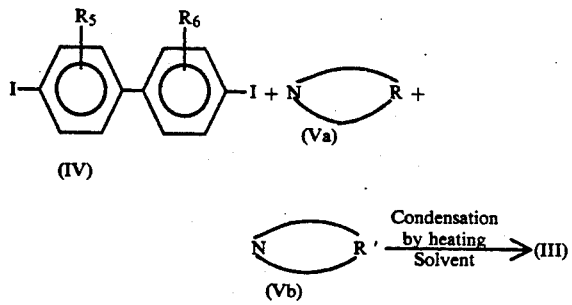

2) A compound represented by general formula (I) in which only $R_1$ and $R_2$, or $R_3$ and $R_4$, combine and form a condensed aromatic ring (i.e., a compound represented by general formula (II)) can be prepared by reacting a corresponding 4-nitro-4'-diiodobipbenyl compound (IVa) and a condensed aromatic secondary amine (Va), such as indoline or 1,2,3,4-tetrahydroquinoline, to obtain a 4-nitro-4'-N-substituted biphenyl compound (IVb), reducing the compound (IVb) in a conventional manner to obtain a 4-amino-4'-N-substituted biphenyl compound (IVc), reacting the compound (IVc) and halogenated benzene derivatives (VIa) and (VIb), such as iodobenzene, 2-, 3-, or 4-iodotoluene.

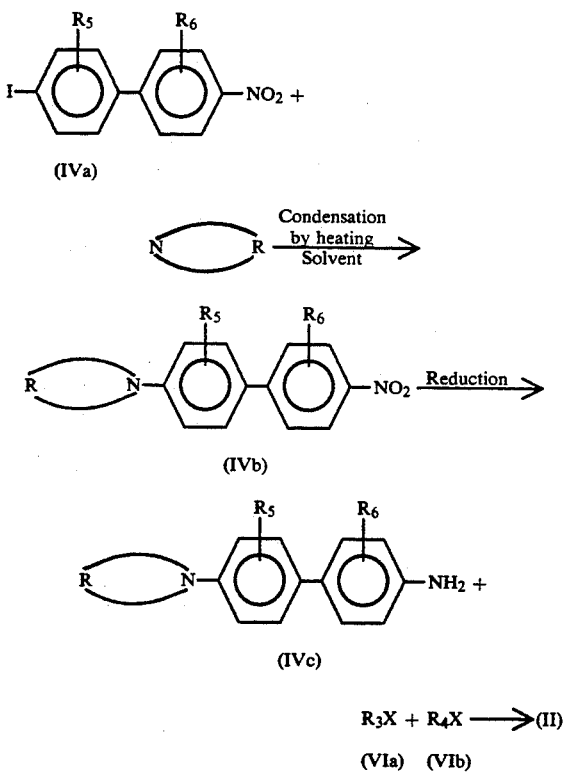

In the above formulae, R, R', $R_3$, $R_4$, $R_5$ and $R_6$ have the same meanings as described above; and X represents a halogen atom.

EXAMPLES

Hereafter, the present invention will be described in more detail by examples. However, the invention should not be construed as being limited thereto.

Preparation Example 1

Preparation of Compound-1

In a three-necked flask were charged 20 g of 4 -nitro-4'-diiodobiphenyl, 12 g of indoline, 21 g of anhydrous potassium carbonate, 3 g of copper powder and 50 ml of sulfolane, and the mixture was heated at 220° C. for 60 hours with stirring. After cooling, 500 ml of water was added and stirred, followed by separation. This procedure was repeated three times. Then, methanol was added to the residue and solids were filtered, which were extracted with a mixed solvent of toluene/n-hexane, and recrystallized.

Elemental analysis of the product was conducted and results obtained are shown in Table 1 below.

The molecular weight of the objective compound was measured using a mass spectrometer FDMS (JMS-AX500) produced by Nippon Denshi Co., Ltd. The molecular weight determined was 388.

TABLE 1

| | Elemental Analysis | | |
|---|---|---|---|
| | C % | H % | N % |
| Found | 87.0 | 5.5 | 7.5 |
| Calculated | 86.6 | 6.2 | 7.2 |

Preparation Example 2

Preparation of Compound-8

In a three-necked flask were charged 16 g of 4-nitro-4'-iodobiphenyl, 6 g of indoline, 11 g of anhydrous potassium carbonate, 2 g of copper powder and 30 ml of sulfolane, and the mixture was stirred at 220° C. for 60 hours for reaction. In a manner similar to Preparation Example 1, 4-nitro-4'-N-substituted biphenyl was obtained, which was then reduced in a conventional manner to obtain 4-amino-4'-N-substituted biphenyl. To this were added 10 g of iodobenzene, 12 g of anhydrous potassium carbonate, 2 g of copper powder, and 30 ml of sulfolane, and the resulting mixture was allowed to react at 23° C. for 40 hours. The reaction mixture was purified in a manner similar to Preparation Example 1 to obtain crystals. Elemental analysis of the objective compound was conducted and results obtained are shown in Table 2 below.

The molecular weight of the objective compound was measured using a mass spectrometer FDMS (JMS-AX500) produced by Nippon Denshi Co., Ltd. The molecular weight determined was 438.

TABLE 2

| | Elemental Analysis | | |
|---|---|---|---|
| | C % | H % | N % |
| Found | 88.0 | 5.4 | 6.6 |
| Calculated | 87.7 | 5.9 | 6.4 |

Other compounds can be prepared similarly.

EXAMPLE 1

A mirror ground aluminum cylinder of a size of 60 mm in outer diameter, 348 mm in length and 1 mm in thickness was dip-coated with a 3% methanol solution of a polyamide (AMILAN CM-8000, produced by Toray Corporation) to form a subbing layer of 0.2 μm in thickness.

Then 2.1 parts by weight of a bisazo pigment having the following chemical structure and 0.6 part by weight of a polyvinyl acetal (ESLEX KS-1, produced by Sekisui Chemical Industry Co., Ltd.) together with 16 parts by weight of methyl ethyl ketone and 9 parts by weight of cyclohexanone were dispersed using a paint shaker, and let down with a coating liquid consisting of 0.3 parts by weight of KS-1 and 75 parts by weight of methyl ethyl ketone to obtain a coating liquid.

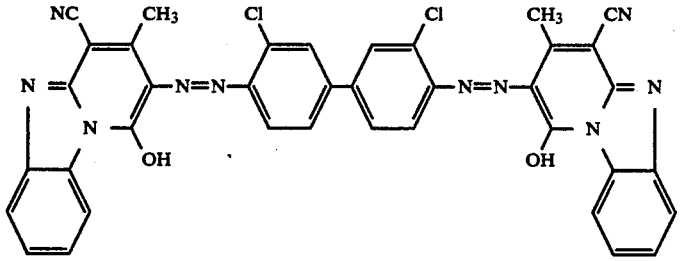

This coating liquid was dip-coated on the aluminum cylinder provided with the subbing layer described above to form a charge generating layer of a dry thickness of 0.4 μm.

Next, a solution of 10 parts by weight of compound-1 above as a charge transporting substance, 10 parts by weight of a polycarbonate (UPIRON PCZ-300, produced by Mitsubishi Gas Chemical Co., Ltd.) in 80 parts by weight of dichloromethane was coated on the charge generating layer to form a charge transporting layer of a dry thickness of 25 μm, thus fabricating a photoconductor.

EXAMPLES 2, 3 AND 4

A photoconductor was fabricated in the same manner as in Example 1 except that the charge transporting substance in Example 1 was replaced by one of compounds-2, -6 and -9.

Comparative Example 1

A photoconductor was fabricated in the same manner as in Example 1 except that the charge transporting substance was replaced by one of the following compounds C-1 to C-4.

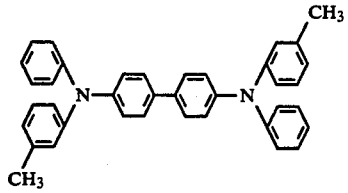

Compound C-1

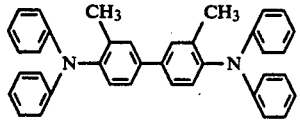

Compound C-2

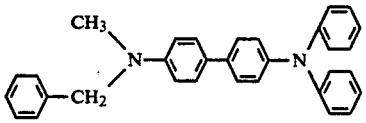

Compound C-3

-continued

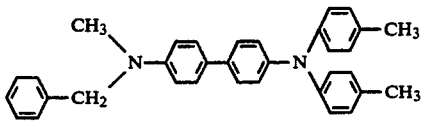

Compound C-4

The photoconductors of Examples 1 to 4 and Comparative Examples 1 to 4 were attached to a commercially available copier (FP-3240, produced by Matsushita Electric Co., Ltd.) and the electrophotographic characteristics thereof were evaluated.

The initial potentials in the dark and in the light of the photoconductor were set to −800 V and −100 V, respectively, and sensitivity was defined by light volume (1x·s) from the potential in the dark to the potential in the light. The potential after exposure to light and after irradiating light in a light volume of 10 (1x·s) was defined as residual potential $V_r$. This procedure was followed at a normal temperature and at a normal humidity (25° C./50% RH), or at a high temperature and at a high humidity (40° C./90% RH) for 5 hours continuously, and the characteristics were measured and changes in the image quality were observed. Results obtained are shown in Tables 3 and 4 below.

TABLE 3

| | Normal Temperature/Normal Humidity | | | | | |
|---|---|---|---|---|---|---|
| | Initial Stage | | | After 5 Hours | | |
| | Sensitivity (1x · s) | Vr | Image Quality | Sensitivity (1x · s) | Vr | Image Quality |
| Example 1 | 1.2 | −19 | Good | 1.3 | −26 | Good |
| Example 2 | 1.3 | −20 | Good | 1.3 | −24 | Good |
| Example 3 | 1.5 | −23 | Good | 1.6 | −28 | Good |
| Example 4 | 1.1 | −18 | Good | 1.2 | −25 | Good |
| Comparative Example 1 | 1.2 | −21 | Good | 1.3 | −27 | Good |
| Comparative Example 2 | 1.4 | −18 | Good | 1.4 | −24 | Good |
| Comparative Example 3 | 1.3 | −19 | Good | 1.4 | −24 | Good |
| Comparative Example 4 | 1.8 | −15 | Good | 1.9 | −20 | Good |

TABLE 4

| | High Temperature/High Humidity | | | | | |
|---|---|---|---|---|---|---|
| | Initial Stage | | | After 5 Hours | | |
| | Sensitivity (1x · s) | Vr | Image Quality | Sensitivity (1x · s) | Vr | Image Quality |
| Example 1 | 1.1 | −25 | Good | 1.3 | −40 | Good |
| Example 2 | 1.1 | −27 | Good | 1.4 | −42 | Good |
| Example 3 | 1.3 | −29 | Good | 1.6 | −50 | Good |
| Example 4 | 1.0 | −24 | Good | 1.5 | −51 | Good |
| Comparative Example 1 | 0.9 | −29 | Good | 2.8 | −190 | Slight fog |
| Comparative Example 2 | 1.1 | −25 | Good | ∞ | −200 | Slight fog |
| Comparative Example 3 | 0.9 | −28 | Good | ∞ | −220 | Slight fog |
| Comparative Example 4 | 1.4 | −28 | Good | ∞ | −210 | Slight fog |

As will be apparent from the results shown in Tables 3 and 4 above, the photoconductors containing the benzidine compound represented by general formula (I) above as a charge transporting substance had stable characteristics at high temperatures and at high humidities.

EXAMPLES 5 TO 8

A 3% methanol solution of a copolyamide (AMILAN CM/8000, produced by Toray Corporation) was dip-coated on an aluminum cylinder of a size of 60 mm in outer diameter, 1 mm in thickness, and 247 mm in length, having a mean surface roughness Rz=1.2 μm to provide a subbing layer of a dry thickness of 0.3 μm. Then, 1 part by weight of X type metal-free phthalocyanine (Fastogen Blue-8120B, produced by Dainippon Ink and Chemicals Co., Ltd.) and 1 part by weight of vinyl chloride copolymer (MR-110, produced by Nippon Zeon Co., Ltd.) were dispersed in 100 parts by weight of methylene chloride using a paint shaker to form a coating liquid. The coating liquid was dip-coated on the subbing layer provided on the aluminium cylinder described above to a dry thickness of 0.5 μm to form a charge generating layer. Next, a coating liquid prepared by dissolving 10 parts by weight of one of compounds-7, -10, -11 and -15 as a charge generating substance and 10 parts by weight of a polycarbonate (UPIRON PCZ-300, produced by Mitsubishi Gas Chemical Co., Ltd.) in 80 parts by weight of methylene chloride was dip-coated on the charge generating layer to form a charge transporting layer of a dry thickness of 25 μm, thus producing a photoconductor.

Comparative Examples 5 to 8

Photoconductors were fabricated in the same manner as in Example 1 except that charge transporting layers containing as a charge transporting substance compounds C-1 to C-4 used in Comparative Examples 1 to 4, respectively, were provided on the charge generating layers formed according to Examples 5 to 8, respectively.

Evaluation of Photoconductors

The photoconductors according to Examples 5 to 8 and Comparative Examples 5 to 8 were attached to a photoconductor process tester, electrified to −600 V using a corotoron, rotated at a peripheral speed of 78.5 mm/sec, irradiated with a light at an exposure wavelength of 780 nm at an intensity of 2 μJ/cm², and measured for an illuminated potential ($V_i$) after 0.2 second from the irradiation and a residual potential ($V_r$) after 1.5 second from the irradiation. Also, the potential in the dark ($V_O$) was measured. These measurements were conducted at a normal temperature and at a normal humidity (25° C./50% RH) or at a high temperature and at a high humidity (40° C./90% RH) . Then the characteristics after allowing them to stand at those conditions for 5 hours were also measured. Results obtained are shown in Tables 5 and 6 below.

TABLE 5

| | Normal Temperature/ Normal Humidity | | | High Temperature/ High Humidity | | |
|---|---|---|---|---|---|---|
| | V0 | Vi | Vr | V0 | Vi | Vr |
| Example 5 | −600 | −50 | −3 | −580 | −40 | −1 |
| Example 6 | −590 | −47 | −4 | −570 | −41 | −2 |
| Example 7 | −600 | −45 | −1 | −590 | −39 | 0 |
| Exmaple 8 | −600 | −33 | −3 | −590 | −29 | −1 |
| Comparative Example 5 | −600 | −65 | −10 | −570 | −50 | −4 |
| Comparative Example 6 | −610 | −60 | −7 | −600 | −40 | −3 |
| Comparative Example 7 | −620 | −81 | −8 | −610 | −73 | −5 |
| Comparative Example 8 | −600 | −77 | −12 | −600 | −61 | −6 |

TABLE 6

| | Normal Temperature/Normal Humidity (After Standing for 5 Hours) | | |
|---|---|---|---|
| | V0 | Vi | Vr |
| Example 5 | −570 | −30 | −4 |
| Example 6 | −560 | −31 | −6 |
| Example 7 | −570 | −29 | −8 |
| Example 8 | −560 | −11 | −7 |
| Comparative Example 5 | −500 | −100 | −50 |
| Comparative Example 6 | −540 | −110 | −49 |
| Comparative Example 7 | −510 | −160 | −70 |
| Comparative Example 8 | −530 | −120 | −80 |

As will be apparent from the results shown in Tables 5 and 6 above, the photoconductors containing the benzidine compounds represented by general formula (I) above as a charge transporting substance had stable characteristics at high temperatures and at high humidities.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

an electroconductive substrate; and a photosensitive layer which is a monolayer formed on said electroconductive substrate and which contains a charge generating substance, a charge transporting substance and a binder resin, said charge transporting substance being a benzidine compound represented by general formula (I):

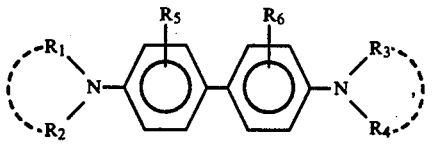

(I)

wherein $R_1$, $R_2$, $R_3$ and $R_4$ are groups selected from the group consisting of an aryl group, an alkylaryl group, an alkoxyaryl group and a halogenated aryl group, provided that (a) $R_1$ and $R_2$ together with the nitrogen atom to which they are bonded combine and form a first condensed heterocyclic ring, or (b) $R_3$ and $R_4$ together with the nitrogen atom to which they are bonded combine and form a second condensed heterocyclic ring, or (c) both (a) $R_1$ and $R_2$ together with the nitrogen atom to which they are bonded, and (b) $R_3$ and $R_4$ together with the nitrogen atom to which they are bonded combine and form said first and second condensed heterocyclic rings, respectively, said first and second condensed heterocyclic rings each having only one heteroatom, nitrogen, wherein $R_5$ and $R_6$ are selected from the group consisting of a hydrogen atom, an alkyl group, an alkoxy group, and a halogen atom, wherein said first and second condensed heterocyclic rings are other than carbazole rings, and wherein at least one of said first and second condensed heterocyclic rings is an indoline ring or a 1,2,3,4-tetrahydroquinoline ring.

2. The photoconductor for electrophotography as claimed in claim 1, wherein said first and second condensed heterocyclic rings are selected from the group consisting of:

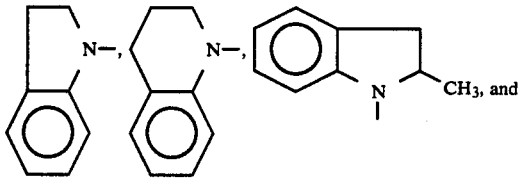

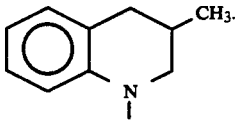

3. The photoconductor for electrophotography as claimed in claim 1, wherein said benzidine compound is selected from the group consisting of:

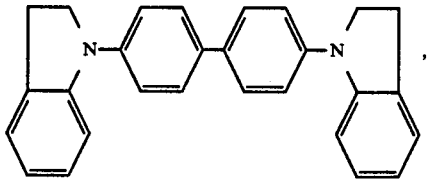

-continued

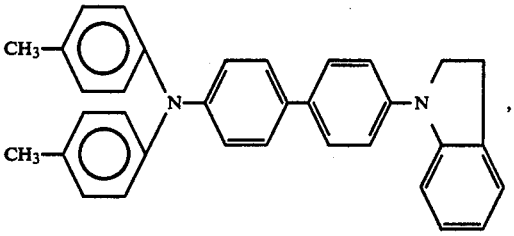

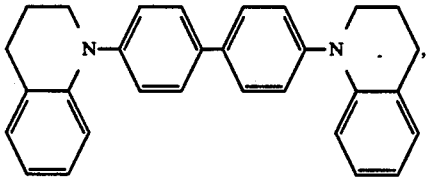

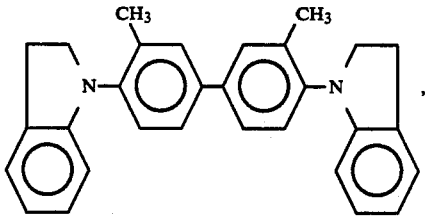

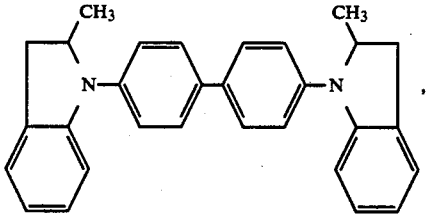

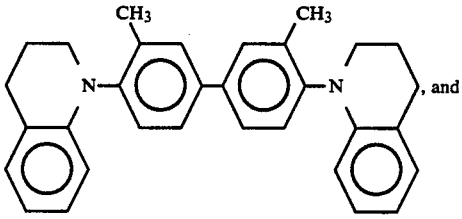

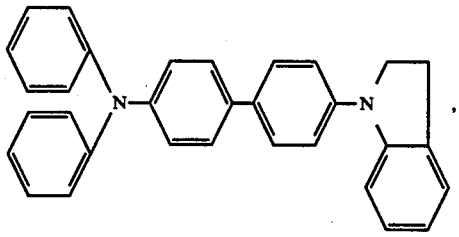

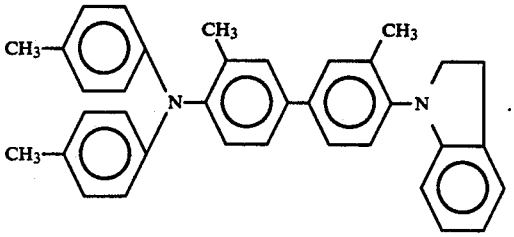

4. The photoconductor for electrophotography as claimed in claim 1, further comprising an intermediate layer between said electroconductive substrate and said photosensitive layer.

5. The photoconductor for electrophotography as claimed in claim 4, wherein said intermediate layer is a barrier layer.

6. The photoconductor for electrophotography as claimed in claim 4, wherein said intermediate layer is a subbing layer.

7. The photoconductor for electrophotography as claimed in claim 1, wherein said charge generating substance is selected from the group consisting of selenium, selenium-tellurium, amorphous silicon, polycrystalline silicon, pyrilium salts, squarylium salts, pyrrolopyrrole compounds, anthanthrone, perylene compounds, disazo compounds, and phthalocyanine compounds.

8. The photoconductor for electrophotography as claimed in claim 1, wherein said photoconductor contains from 2 to 20 parts by weight of said charge generating substance and from 40 to 200 parts by weight of said charge transporting substance per 100 parts by weight of said binder resin.

9. A photoconductor for electrophotography, comprising:

an electroconductive substrate; and a photosensitive layer which is formed on said electroconductive substrate and which has a charge generating layer containing a charge generating substance and a charge transporting layer containing a charge transporting substance provided on one another, wherein said charge transporting substance is a benzidine compound represented by general formula (I):

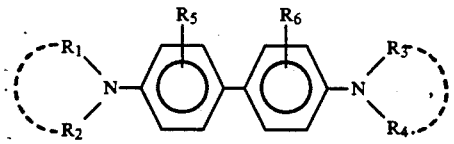

(I)

wherein $R_1$, $R_2$, $R_3$ and $R_4$ are groups selected from the group consisting of an aryl group, an alkylaryl group, an alkoxyaryl group, and a halogenated aryl group, provided that (a) $R_1$ and $R_2$ together with the nitrogen atom to which they are bonded combine and form a first condensed heterocyclic ring, or (b) $R_3$ and $R_4$ together with the nitrogen atom to which they are bonded combine and form a second condensed heterocyclic ring, or (c) both (a) $R_1$ and $R_2$ together with the nitrogen atom to which they are bonded, and (b) $R_3$ and $R_4$ together with the nitrogen atom to which they are bonded combine and form said first and second condensed heterocyclic rings, respectively, said first and second condensed heterocyclic rings each having only one heteroatom, nitrogen, wherein $R_5$ and $R_6$ are selected from the group consisting of a hydrogen atom, an alkyl group, an alkoxy group, and a halogen atom, wherein said first and second condensed heterocyclic rings are other than carbazole rings, and wherein at least one of said first and second condensed heterocyclic rings is an indoline ring or a 1,2,3,4-tetrahydroquinoline ring.

10. The photoconductor for electrophotography as claimed in claim 9, wherein said first and second condensed heterocyclic rings are selected from the group consisting of:

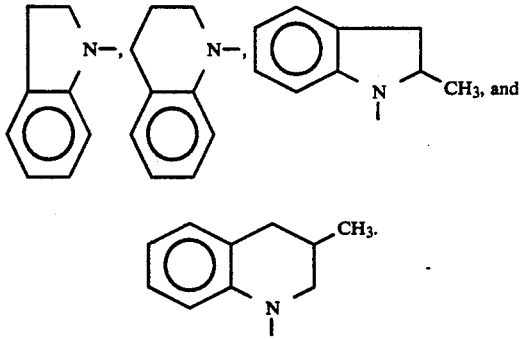

11. The photoconductor for electrophotography as claimed in claim 9, wherein said benzidine compound is selected from the group consisting of:

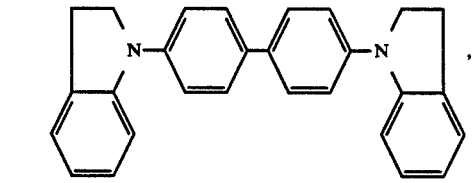

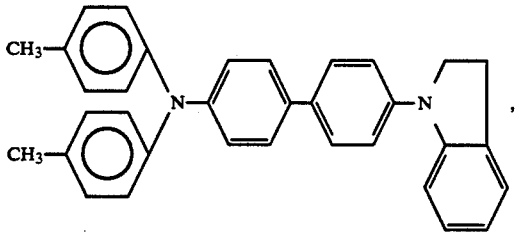

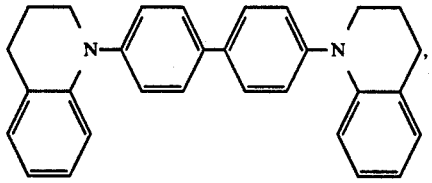

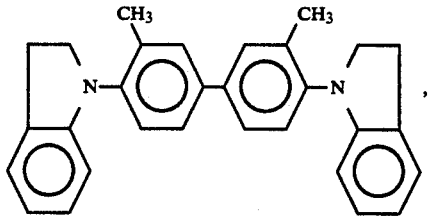

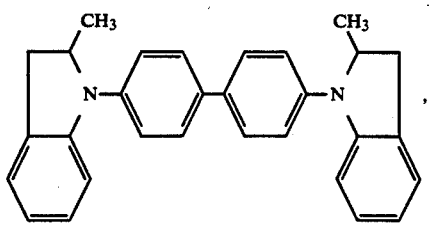

-continued

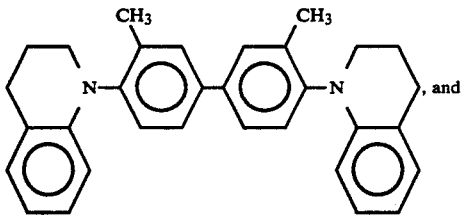

, and

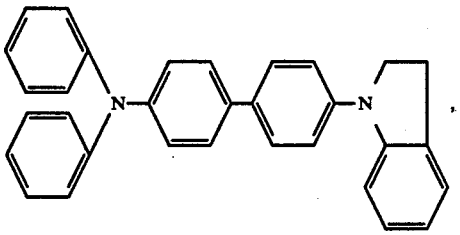

,

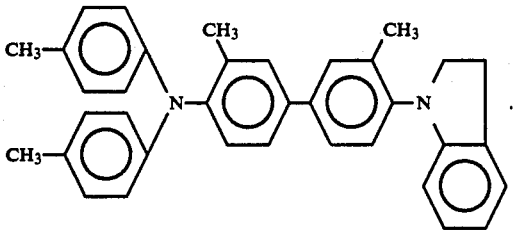

.

12. The photoconductor for electrophotography as claimed in claim 9, further comprising an intermediate layer between said electroconductive substrate and said photosensitive layer.

13. The photoconductor for electrophotography as claimed in claim 12, wherein said intermediate layer is a barrier layer.

14. The photoconductor for electrophotography as claimed in claim 12, wherein said intermediate layer is a subbing layer.

15. The photoconductor for electrophotography as claimed in claim 9, further comprising a cover layer provided on said photosensitive layer.

16. The photoconductor for electrophotography as claimed in claim 9, wherein said charge generating substance is selected from the group consisting of selenium, selenium-tellurium, amorphous silicon, polycrystalline silicon, pyrillium salts, squarylium salts, pyrrolopyrrole compounds, anthanthrone, perylene compounds, disazo compounds, and phthalocyanine compounds.

17. The photoconductor for electrophotography as claimed in claim 16, wherein said charge generating substance is at least one pigment selected from the group consisting of dibromoanthanthrone pigments, azo pigments, and phthalocyanine pigments.

18. The photoconductor for electrophotography as claimed in claim 9, wherein said charge transporting layer contains a binder resin and from 10 to 300 parts by weight of said charge transporting substance per 100 parts by weight of said binder resin.

* * * * *